United States Patent [19]

Gunn

[11] Patent Number: 4,872,388

[45] Date of Patent: Oct. 10, 1989

[54] STRING ANCHORING AND TRIMMING DEVICE

[76] Inventor: Dennis R. Gunn, Tashiro-so, 2-9-2, Kamiochiai Shinjuku-ku, Tokyo, Japan, 161

[21] Appl. No.: 89,505

[22] Filed: Aug. 26, 1987

[30] Foreign Application Priority Data

Feb. 12, 1986 [JP] Japan ..... 61-185115

[51] Int. Cl.[4] ..... G10D 3/00

[52] U.S. Cl. ..... 84/297 R; 83/199; 30/124; 30/131

[58] Field of Search ..... 84/200–208, 84/304–306, 314 N, 297 R, 297 S, 453, 458; 83/199; 30/124, 131, 134, 135

[56] References Cited

U.S. PATENT DOCUMENTS

| | | | |
|---|---|---|---|
| 2,507,059 | 5/1950 | Suman | 83/199 |
| 4,192,213 | 3/1980 | Steinberger | 84/297 R |
| 4,625,614 | 12/1986 | Spercel | 84/304 |

*Primary Examiner*—L. T. Hix
*Assistant Examiner*—Brian W. Brown
*Attorney, Agent, or Firm*—Foley & Lardner, Schwartz, Jeffery, Schwaab, Mack, Blumenthal & Evans

[57] ABSTRACT

A device for affixing strings to a musical instrument includes a blade or blades for trimming excess string from the end of a string so that when a string mounting operation is performed by means of the device, the string is trimmed to a length that is appropriate for the instrument.

26 Claims, 7 Drawing Sheets

STRING ANCHORING AND TRIMMING DEVICE

The present invention relates to a musical instrument equiped with a device for trimming the strings thereof to an appropriate length therefor. More specifically the present invention relates to a device which integrates the functions of anchoring one end of a string and trimming said string to a length appropriate for said musical instrument.

BACKGROUND OF THE INVENTION

In stringed musical instruments such as guitars, violins, pianos, etc. it is ocasionally necessary to replace the strings due to breakage, brand or size preference, deterioration of sound quality or other factors. This is particularly true in the case of guitars and bass guitars the strings of which need to be replaced fairly frequently.

When changing of a string or strings of a musical instrument becomes necessary a problem almost always arises in that strings for a given type of stringed instrument are usualy sold in lengths intended to be long enough to be fitted to any variation of said given type of stringed instrument with some extra string length left to spare. However, unless the extra string is trimmed, either before or after fitting the string to the instrument, it becomes an unasthetic and or functional nuisance as well as a safety hazard. Therefore, it is the most common practice to trim away the extra string as a part of the normal string instalation procedure.

Normaly, trimming of the instrument string is accomplished either by means of wire cutters, which are an additional expense for the user and not always available, or by manualy "crimping" or distressing the material of the string at a selected spot which corresponds to the desired length of the string and then applying enough tension to the string to cause it to break at the distressed section thereof. This method is both time consuming and dangerous to the user in that the user is at considerable risk of having his or her hand cut by the string while applying tension thereto.

There is known in the prior art a device, U.S. Pat. No. 4,192,213, which overcomes these difficulties by providing a guitar with means for accomodating special strings which have balls on both ends thereof (double ball end strings) and which are of a predetermined length that is appropriate for said guitar.

There is however a disadvantage with this system in that in many places in which conventional single ball end strings are readily avialable for purchase, the double ball end strings are not. Furthermore the double ball end strings are almost allways more expensive and the brand selection much more limited than conventional single ball end strings.

SUMMARY OF THE INVENTION

It is therefore an object of the present invention to overcome the aforementioned shortcommings inherent in the existing methods of fastening and trimming the strings of a musical instrument and to provide a musical instrument with an apparatus that can trim one end of a string of a musical instrument to a length appropriate for said musical instrument and further to to provide a musical instrument with an apparatus that combines the functions of anchoring one end of a string on a musical instrument and trimming the string to a length appropriate for the musical instrument.

It is another object of the present invention to provide a musical instrument with a means for stably and securely affixing the strings in such a manner as to prevent slippage and resulting pitch variations of the strings.

It is still another object of the invention to provide a stringed instrument with a device by which string trimming and string fastening can be performed simultaneously in a single operation.

It should be appreciated that this would be considered to be a great advantage by a musician in an on stage situation where an overly long pause to replace a damaged string may seriously disrupt the "flow" of a performance.

In order to accomplish the above stated objects a string anchoring device according to the present invention comprises a movable member and a stationary member. A blade is provided on the movable and or the stationary member to cut a string of the musical instrument to appropriate length therefor. In the cases where a blade is provided on both the movable and the stationary member, the blades cooperate to form shearing means for cutting the string. In the cases where only one blade is provided, a surface on the one of the members that is not provided with the blade acts as an anvil and the blade acts as a chisle so that the two members cooperating form an anvil and chisle type cutting means for trimming the string to the desired length.

In one embodiment the movable member is the string barrel of a guitar tuner and the stationary member is a ring shaped member, having a blade formed thereon, mounted around the base of the string barrel. A cutting edge defined on a corner of a string mounting hole, which runs diagonaly through the string barrel, forms a blade which cooperates with the blade of the ring shaped member to form a shearing means for cutting off the section of the string that protrudes from one end of the string mounting hole.

In another embodiment the movable member is an eccentric cam journaled, via a pin, to the stationary member for clamping a section of the string between a clamping surface of the stationary member and a surface of the eccentric cam when the cam is in an "engaged" position. A handle is provided on the cam for operating the cam into the "engaged" or a "released" position. A chisle type blade provided on the stationary member is so arranged that when the cam is in the engaged position the edge of the chisle type blade is in contact with an "anvil" section of the lower surface of the cam member so that the anvil section of the cam member and the chisle type blade cooperate to form cutting means for trimming the string when the cam member is operated into the engaged position.

IN THE DRAWINGS

DETAILED DESCRIPTION OF THE INVENTION

Herein described are five embodiments of the present invention.

Figure 1:
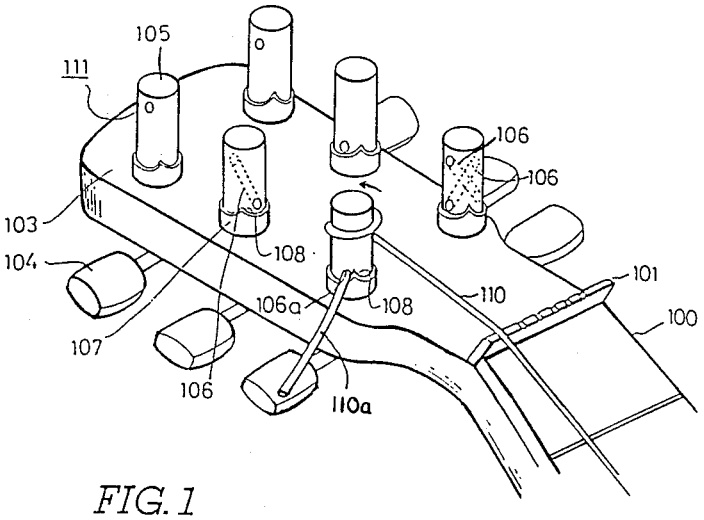
FIG. 1 is a perspective veiw depicting the first embodiment of the invention as it would appear on the tuning mechanism of a guitar.
Figure 2:
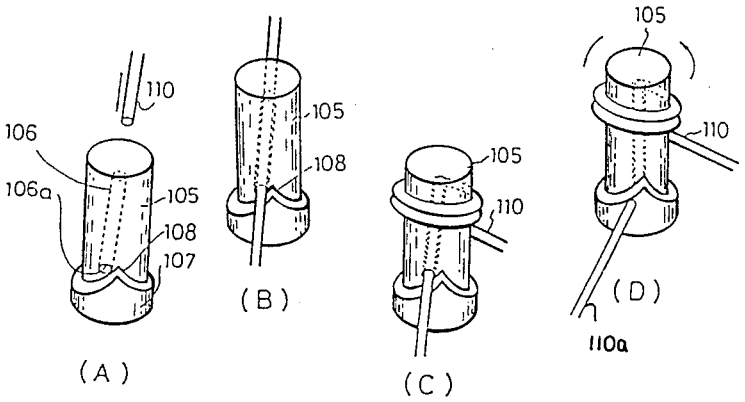
FIG. 2 depicts a string mounting operation according to the first embodiment of the invention.
Figure 3:
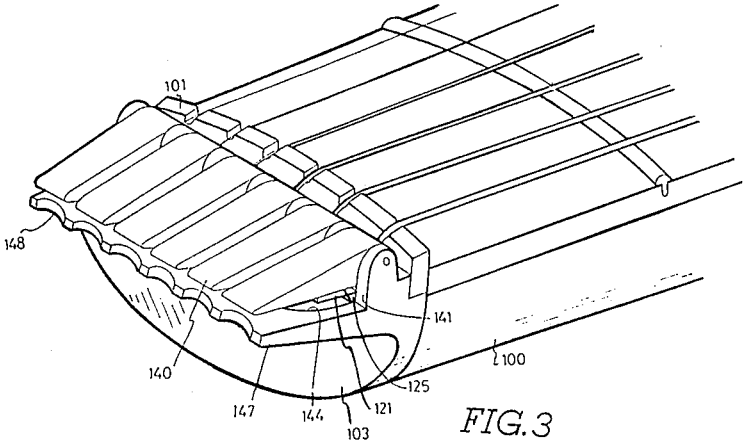
FIG. 3 is a perspective veiw depicting the second embodiment of the invention as it would appear on the neck of a headless guitar.
Figure 4:
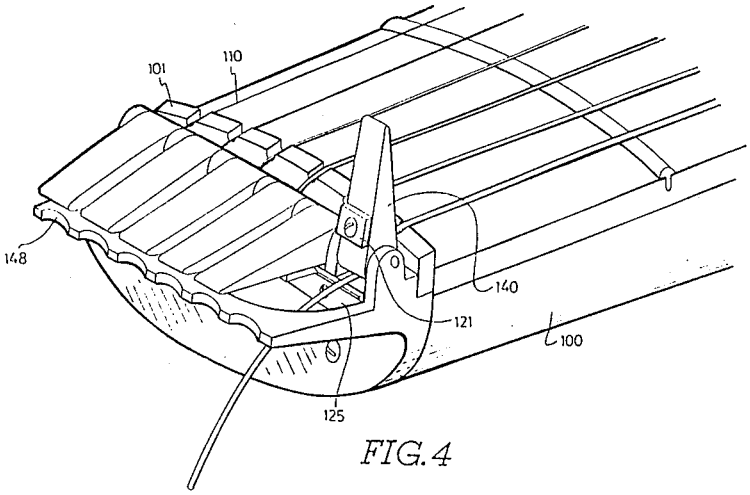
FIG. 4 depicts the second embodiment of the invention with one of the cam members in the released position.
Figure 5:
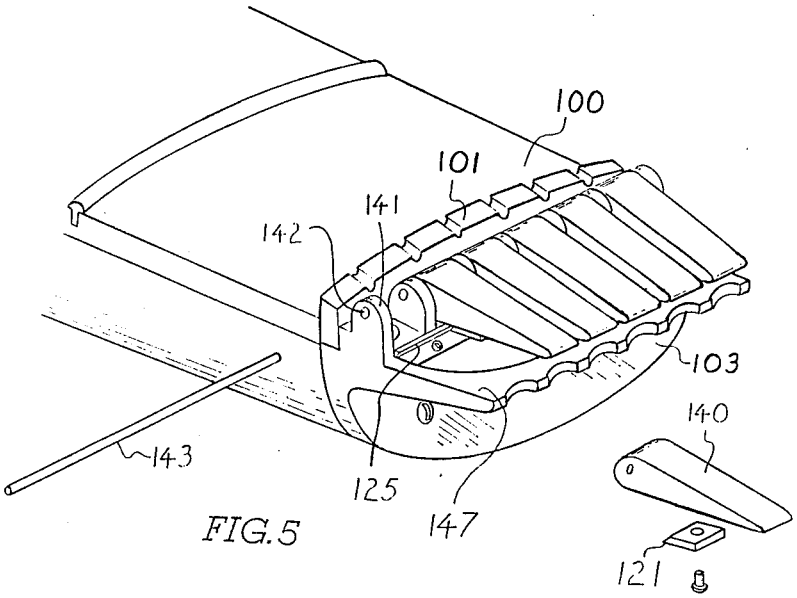
FIG. 5 is an exploded veiw of the second embodiment of the invention.
Figure 6:
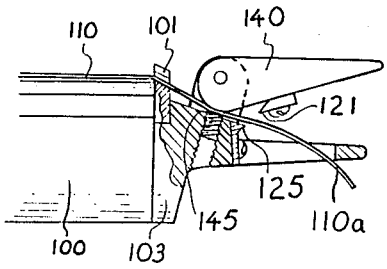
FIG. 6 is a partialy cutaway side veiw of the second embodiment of the invention.
Figure 7:
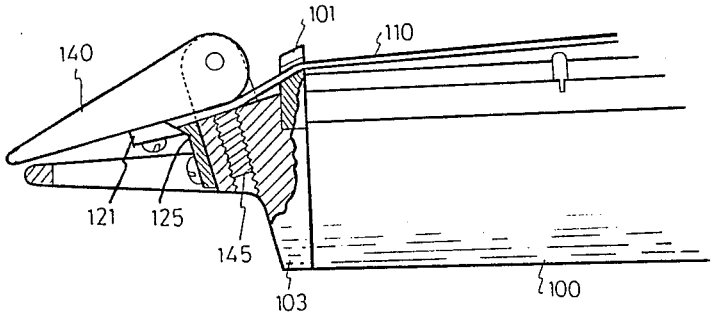
FIG. 7 is a partialy cutaway side veiw of the second embodiment of the invention in which the cam member has been operated to a clamped position.

With reference now to FIGS. 1 and 2, a guitar head 103 at the end of a guitar neck 100 is depicted. Mounted thereon is the first embodiment the invention formed integraly with otherwise conventional tuning mechanisms 111 of the type commonly used for guitars. It is assumed that one end (not shown) of the string 110 is affixed to the bridge section of a guitar (not shown) although this is not a necessary precondition for operation of the invention and is mentioned only for clarification of the illustration.

In the shown embodiment the rotating rod section 105 of a tuner mechanism 111, commonly reffered to as the string barrel 105, around which the string 110 is wrapped, is formed with one or more holes 106 running through it at an angle that is not perpendicular or parallel to its rotational axis. Said hole or holes will hereafter be reffered to as diagonal string mounting hole 106. The string barrel 105 is formed of a material that is harder than the material from which musical instrument strings 110 are formed.

Rotational energy for turning the string barrel 105 is provided in the conventional manner by manually turning the tuning peg 104 which is coupled to the string barrel 105 through a worm gear (not shown) as is well known to those skilled in the art.

The string barrel 105 passes through a ring shaped member 107 at the portion closest to the surface of the guitar head 103, the ring shaped member 107 is fixedly mounted and is stationary with regard to the guitar head 103.

The ring shaped member 107 has a portion 108 that protrudes in the direction away from the surface of the guitar head, for convenience this direction shall be considered "up". This protruding section 108 shall be hereafter reffered to as the stationary shearing blade 108.

The stationary shearing blade 108 is essentially triangular in shape an rests against the lower portion of the string barrel 105. The stationary shearing blade 108 protrudes upward just enough that when the string barrel 105 is rotated to the position where the lower opening 106*a* of the diagonal string mounting hole 106 occupies the same position of rotational arc as the stationary shearing blade 108, the top of the stationary shearing blade 108 is slightly higher than the top of the lower opening 106*a* of the diagonal string mounting hole 106. The diagonal string mounting hole 106 is formed at enough of an angle relative to the rotational axis of the string barrel that it's higher opening, on the other hand, remains completely clear of the stationary shearing blade 108 throughout the full 360 degrees of its rotational arc.

As will be seen from FIG. 2, (A) through (D) a string mounting and trimming operation according this embodement consists of the following steps:

FIGS. (A) and (B) Inserting the string 110 into the upper opening of the string mounting hole 106 with a certain amount of slack left to ensure that at least one turn of the section of the string 110 protruding from the upper opening of the string mounting hole 106 can be wound around the string barrel. At this point the exess portion 110*a* of the string 110 will be protruding from the lower opening 106*a* of the string mounting hole 106.

FIG. (C) Winding the section of the string 110 protruding from the upper opening of the string mounting hole 106 at least one turn around the string barrel 105.

FIG. (D) Adjusting the string to the desired tension (tuning) by means of the tuning peg 104.

When the lower opening 106*a* of the diagonal string mounting hole 106 is rotated past the stationary shearing blade 108 during the tuning operation, a blade defined on the corner of the lower opening 106*a* of the diagonal string mounting hole 106 and the stationary shearing blade 108 cooperate to form a cutting means for trimming off the exess string portion 110*a*.

Thus, by eliminating the necessity for a separate string trimming operation, the invention greatly reduces the length of time necessary for mounting strings to the instrument.

Further, since the angle at which the string 110 can be bent at the point where it enters the diagonal string mounting hole 106 is greater than that of conventional tuners, the string has less tendency to slip or pull out of the hole. Thus the embodiment provides the added advantage of reducing string slippage which can cause tuning problems as is well known to those familiar with the art.

The second embodiment of the present invention shall now be dicussed with refference to FIGS. 3–7.

In the shown embodiment the invention is depicted as it might apear on a "headless" type gutar or bass guitar on which the ball end of the string is mounted on a tuning means located on or near the tail piece or the bridge (not shown) of the guitar. The tuning means forms no part of this invention and shall not be discussed further in this disclosure.

At its other end the string is anchored by means of a device embodying the invention.

As can be seen from FIGS. 3 through 7, the embodiment comprizes an anchoring member main body 103 mounted on the end of a guitar neck 100 of a headless type guitar and formed with crenelations 141 arranged in a line perpendicular to the axis along which the strings 110 of the guitar lie and essentialy parallel to the nut 101. The crenelations accomodate, in the recesses therebetween, a plurality of movable cam members 140.

The crenelations are formed therethrough with a hole 149 for recieving a pin 143. The pin 143 serves as a pivoting axis for the movable cam members 140 each of which is formed with a hole 142 by which it is journaled to the pin 143.

Each of the movable cam members 140 is formed at it's leading edge with an eccentric cam section and at it's opposite end with a handle section, in such a way that it may be rotated around the pin 143 by means of the handle to cause the width of a gap between the surface of the eccentric cam section and an adjustable achoring surface 145*a* to diminish and thereby cause a section of a string 110 inserted therebetween to become clamped between the eccentric cam and the and the adjustable mounting surface.

The adjustable anchoring surface, which may take the form of a flat face 145*a* on an end of a screw 145 or of a slidable wedge, is provided on the anchoring member main body to adjust the width of the gap between its surface and the clamping surface of the movable cam member in accordance with string thickness and the desired amount of clamping pressure.

A guard 147 is formed integraly on the anchoring member main body so that when a movable cam member 140 is in the "clamped" position, the handle thereof will be lieing essentialy parrallel to the upper surface of the guard 147 that is provided for preventing accidental release of the movable cam member 140.

Figure 8:
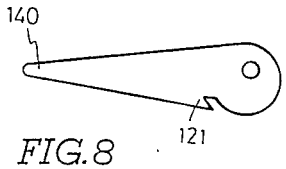
FIG. 8 depicts a cam member for the second embodiment of the invention with the blade formed directly thereon.

The movable cam member has a blade 121 mounted, as in FIGS. 3 through 7, or formed integrally as FIG. 8, thereon in such a way as to cooperate with another blade 125 mounted on the anchoring member main body to form a cutting mechanism for cutting away exess string 110*a*.

Thus a string mounting operation according to this embodiment comprises the steps:

a. Attaching the ball end of the string to the tail peice by the conventional method.

b. While the cam member 140 is in a "released" position, inserting the free end of the string 110 into the gap between the adjustable mounting surface 145*a* and the cam section of the movable cam member and drawing it somewhat taught, after doing so the excess string portion 110*a* will pass between the blades 121 and 125.

c. Rotating the movable cam member downward (counter-clockwise in the FIGS.) causing a section of the string to become clamped between the adjustable mounting surface 145*a* and the cam section of the movable cam member 140 and causing the blades 121 and 125 to cooperate to cut away the exess string portion 110*a*.

Figure 9:
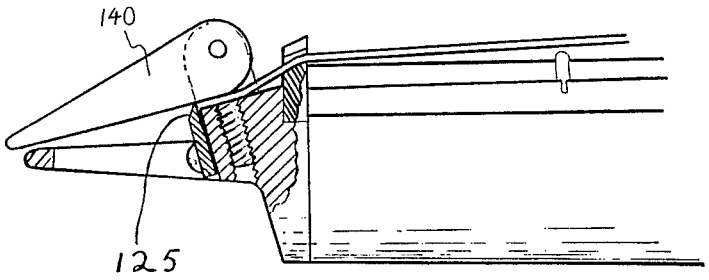
FIG. 9 depicts a chisle and anvil type blade arrangement which may be employed in the invention.
Figure 10:
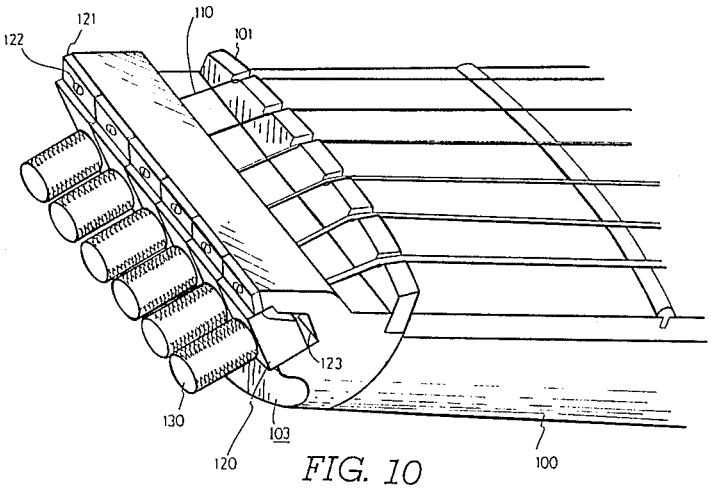
FIG. 10 is an exploded perspective veiw depicting the fourth embodiment of the invention as it would appear on the neck of a headless type guitar.
Figure 11:
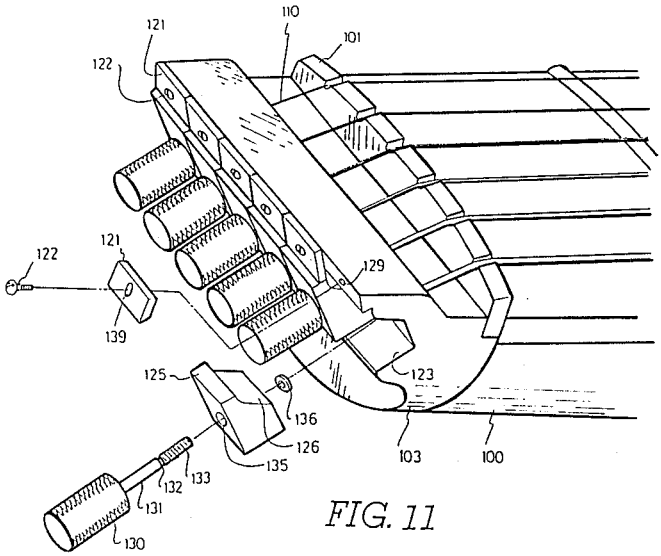
FIG. 11 is a partialy cutaway side veiw of the fourth embodiment of the invention with the wedge member in the released position.
Figure 12:
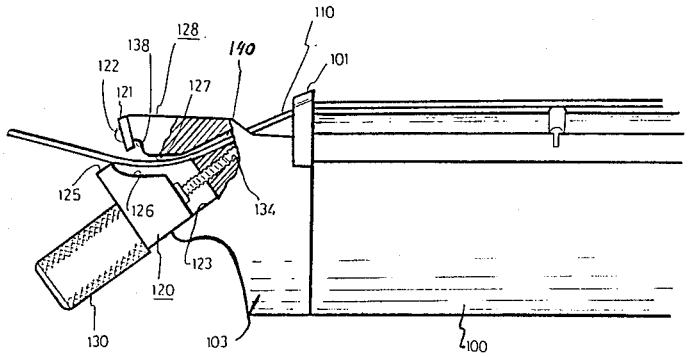
FIG. 12 is a perspective veiw of the fifth embodiment of the invention with two of the blade bearing members removed.

Thus, with this embodiment, it's possible to affix the string and trim it to length simultainiously by one movement of a lever. Therefore the length of time nessesary to mount a string to the instrument is greatly reduced in comparison to that required by methods employed in the prior art. Furthermore although the embodiment described above employes a shearing type blade arrangement other types of blade arrangement, such as a chisle and anvil type blade arrangement as in the third embodiment ilustrated in FIG. 9 for example, wherein the blade 125 is a chisle and the bottom of the cam member 140 serves as the anvil may be employed without departing from the scope of the invention.

It shall further be noted that though the handles of the individual cam members 140 in the pictured second and third embodiments are depicted as being straight and of equal length, it may be advantageous to make them of inequal length and or bent and or having enlarged sections at the ends thereof so as to make it easier to operate an individual cam member without accidentaly operating a cam member adjacent to it.

The fourth embodiment of the invention is also depicted as it might apear on a headless type guitar or bass but should not be taken to be restricted to use on such.

As in the second embodiment of the invention the ball end of the string is attached at the bridge end of the guitar in a per se well known manner and at it's other end the string is anchored by means of the invention.

As shown in FIGS. 10 through 13, the embodiment comprises an anchoring member main body 103 disposed on the end of the neck 100 of a headless guitar and formed with a groove having a wedge shaped cross section.

The groove is so formed as to accomodate a plurality of wedge shaped blade bearing members 120 each of which is associated with a string 110. Each of the blade bearing members has a wedge surface 126 and a sliding surface 124 and is slidably mounted within the groove so as to be adjustable along an axis that is parallel to one of the inside planar surfaces 123 of the groove. This surface will hereafter be referred to as the sliding surface 123 of the groove. The angular relationship between the planes formed by the wedge surface 126 and the sliding surface 124 of the blade bearing members is essentialy identical to that of the planes formed by the inside planar surfaces 123 and 127 of the groove. Therefore, the wedge shaped blade bearing members 120 can fit snugly into the groove.

Each of the blade bearing members is formed with a hole 135 running parallel to its sliding surface 124 for accomodationg a shaft section 131 of a finger screw 130.

The finger screw is threaded into a hole 134 provided at the bottom of the groove. The finger screw 130 is formed with a cicumferencial groove 132, at a portion of its length coresponding the bottom of the blade bearing member 120, into which a stop ring 136 is inserted for limiting movement of the blade bearing member to a portion 131 of the shaft of the finger screw defined between the head of the finger screw and the stop ring 136. Thus the position of the blade bearing member 120 may be adjusted in the direction of the axis of the finger screw 130 by turning the finger screw.

Each of the blade bearing members has defined on one edge thereof a blade section 125 which, in cooperation with a stationary blade 121 mounted or formed on the anchoring member main body 103, forms a shearing means.

The anchoring member main body 103 is formed with a plurality of string mounting holes 140 each of which runs from a position near the nut 101 of the guitar to a position within the groove corresponding to an associated blade bearing member 120 for accomodating therethrough a string 110. Each of the string mounting holes 140 is so aligned that a string 110 inserted from the side near the nut 101 will be caused to pass between the wedge surface 127 of the groove and the wedge surface 126 of the blade bearing member 120 and any excess string will pass between the blades 125 and 122 which form the shearing means.

Figure 13:
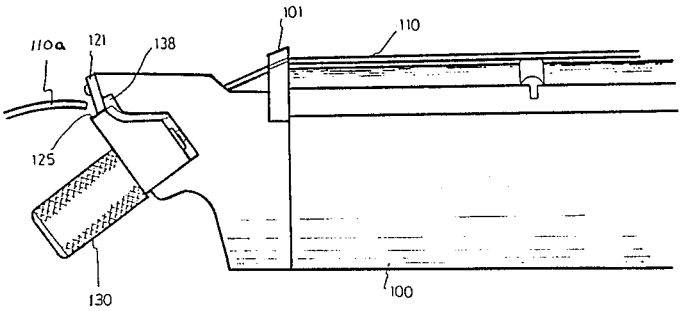
FIG. 13 is a partialy cutaway side veiw of the fifth embodiment of the invention with the blade bearing member in the clamped position.

Thus, as can be seen from FIG. 13 when the finger screw 130 is tightened causing the blade bearing member 120 to slide into the groove the blades 121 and 125 form a shearing means for cutting away the excess string portion 110*a* of the string. Then as tightening of the finger screw 130 is continued the wedge surface 126 of the blade bearing member 120 and the wedge surface 126 of the groove cooperate to form a clamping means for clamping the string.

The wedge configuration of the blade bearing member 120 effectively serves to reduce the amount of torque that must be applied to the finger screw 130 for clamping the string 110 securely.

Furthermore, with this configuration, since while the string is tuned the string tension is in the general direction of the bottom of the groove, friction exerted on the wedge surface 126 of the blade bearing member by the string 110 tends to pull the blade bearing member 120 more tightly into the groove thereby increasing clamping pressure on the string 110 and thus greatly reducing the chances of string slippage.

When it becomes nessesary to remove a string 110 clamped by the means described above the finger screw 130 is unscrewed. The rotation energy applied to the screw is translated into an outward thrusting force which is exerted on the bottom of the blade bearing member 120 by the upper surface of the stop ring 136 thus assuring that the blade bearing member 120 can be released from clamping contact with the string 110 and does not remain wedged into the groove due to friction between the wedge surface 126 and the string 110.

Thus the fourth embodiment achieves the stated aims of providing a stringed musical instrument with a device of simple construction by which the strings of the musical instrument may, in a single operation, be affixed to the musical instrument and trimmed to a length appropriate for the stringed musical instrument.

Figure 14:
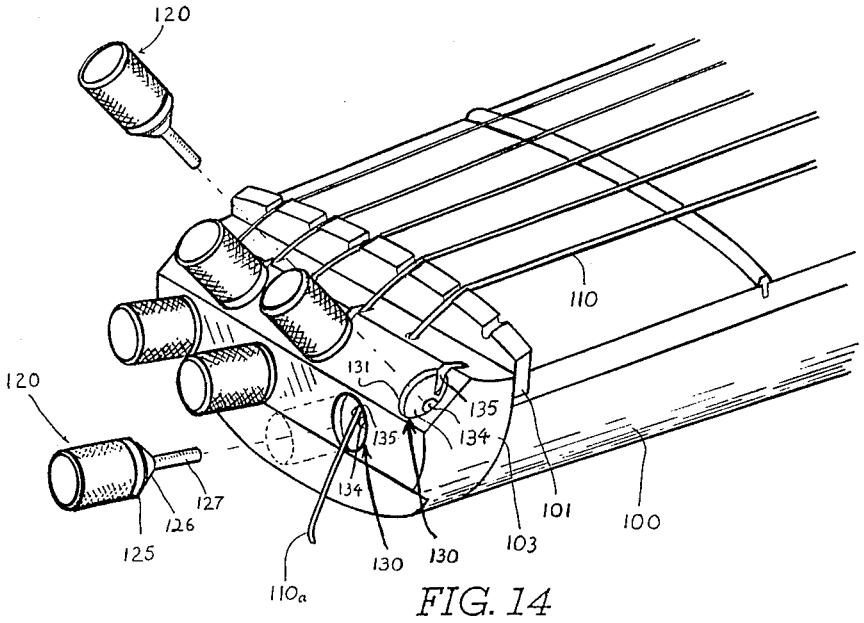
FIG. 14 is an exploded perspective view of the fifth embodiment of the invention.
Figure 15:
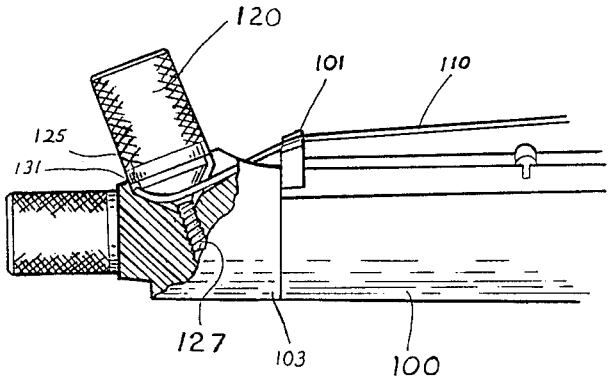
FIG. 15 is a partially cutaway side elevation of the fifth embodiment according to the present invention.

In the fifth embodement of the present invention illustrated in FIGS. 14 and 15, the invention is again depicted as it might appear on a headless guitar.

The blade bearing members take the form of finger screws 120 each of which has a circular cutting edge 125 defined at the edge of a rod shaped section thereof and has a frustal section 126 formed so as to mate with a funnel shaped hole 130 formed in the anchoring member main body 103 which is mounted on the end of the neck 100 of the guitar. The upper sections 131 of the funnel shaped holes 130 into which the blade bearing members 120 are received are cylindrical and are slightly larger in diameter than the the cutting edge 125 of the blade bearing members 120.

A blade 131 is defined on the upper periphery of the cylindrical section 132 of each of the the funnel shaped holes 130. The central section 133 of each of the funnel shaped holes 130 is a conical indentation which mates with the frustal 126 section of a blade bearing member 120. The lower section 134 of each of the funnel shaped holes 130 is threaded for receiving the threaded section 127 of a blade bearing member.

The anchoring member main body 103 is also formed with channels or holes 135 each of which has one end open into the conical section 133 of one the funnel shaped 130 holes and another end open at a spot, outside of the funnel shaped hole, that is adjacent the nut 101 of the instrument so as to allow a string 110 to be passed from said outside location into the bottom of the conical section 133 the funnel shaped hole 130 without passing between the circular cutting edges 125 and 131.

When a string 110 is inserted through the passage 135 into the bottom of the conical section 133 of one of the funnel shaped holes 130, the extra string portion **110*a* thereof is caused to pass between the cutting edge 125 of the blade bearing member and the cutting edge 131 defined on the upper corner of the funnel shaped hole. Therefore, when the blade bearing member 120 is screwed inward, its cutting edge 125 and the cutting edge 131 of anchoring member main body 103 cooperate to form a shearing type cutting means for trimming away the exess string portion 110*a*. As the blade bearing member 120 is screwed further inward, a section of the string 110 is squeezed between the inside surface 133 of the funnel shaped hole 130 and the conical surface 126 of the blade bearing member 120** thereby firmly affixing the string. It shall be noted that the cone shape of the blade bearing member and the funnel shape of the hole cause a wedge effect to occur therebetween which increases the amount of squeezing pressure that can be applied via the finger screw to the string.

In the pictured embodiment, it will be noted that the funnel shaped holes 130 are formed with their axes normal to two different planar surfaces of the anchoring member main body so as to allow the finger screws to be large in diameter without making the anchoring member main body large. In this way the finger screws can be made large enough in diameter to give the user sufficient mechanical advantage to be able to apply enough force to the string to cut it and firmly clamp it by manually turning the finger screw. With this arrangement, since the number of finger screws whose axes are parrallel is reduced, and the difference in angle between the axes of the finger screws which are not parallel is great, accessability to the individual finger screws is increased. In the shown embodiment, three of the funnel shaped holes are on one surface and three are on another, but the number of surfaces on which the funnel shaped holes may be formed shall not be taken to be limited to two. It will be further noted that a similar effect may be achieved by radially arranging the holes on a curved surface.

What is claimed is:

1. A device for securing a filament onto a support member and trimming said filament which comprises:

a stationary member which is non-movable relative to said support member;

a movable member selectively movable, relative to said stationary member, to a filament securing position from which said movable member cannot be moved relative to said support member, by tension in said filament, in a direction which would cause said filament to become released therefrom;

an actuator operable to selectively move said movable member relative to said stationary and support members; and a blade provided on one of said stationary and movable members for cutting said filament when said movable member is actuated toward said filament securing position.

2. A device as set forth in claim 1 wherein said movable member is a rod rotatably actuable relative to said support member for windingly securing said filament therearound and imparting tension thereto and said rod is formed with a channel through which said filament can be passed, said blade is defined on a corner of an opening of said channel, said blade on said movable member cooperating with a second blade on said stationary member to form a shearing means.

3. A device as set forth in claim 1 in which said movable member is an eccentric cam member provided with a handle, said eccentric cam member is arranged adjacent said stationary member to be operable for clampingly securing a portion of said filament inserted therebetween.

4. A device as set forth in claim 1 wherein said movable member comprises:

a screw section a rod section, an edge defined on an end of said rod section, a blade defined on said edge, and a first clamping surface defined at one side of said edge for clampingly engaging a string, and in which said stationary member is formed with a hole in which are defined:

a threaded section for receiving said screw section of the movable member;

a cylinder section for receiving said rod section, a part of said cylinder section having an edge section defined thereon, a blade defined on said edge section cooperating with said blade of said movable member to form cutting means;

a second clamping surface cooperating with said first clamping surface of the movable member to form a clamping means; and a passage from said clamping surface to a point on the surface of said stationary member.

5. A device as set forth in claim 1 in which said movable member is a wedge member and said stationary member is formed with a groove for accommodating said wedge member therein and said stationary member and said movable member cooperate to form a clamping means for clampingly securing a portion of said filament therebetween.

6. A device as set forth in claim 1 wherein said filament is the string of a musical instrument.

7. A device as set forth in claim 2 in which said movable member is a string mounting member of a tuning mechanism of a stringed instrument.

8. A device as set forth in claim 7 in which said tuning mechanism is a guitar tuner.

9. A device as set forth in claim 8 in which operation of the tuning mechanism causes said shearing means to trim away a portion of said filament protruding from an opening of said channel.

10. A device as set forth in claim 3 wherein said filament is the string of a guitar.

11. A device as set forth in claim 3 in which an edge provided on said cam member forms a first blade, an edge provided on said stationary member forms a second blade and upon oscilation of said cam member said first and second blades cooperate to form a shearing type cutting means.

12. A device as set forth in claim 11 wherein said filament is the string of a guitar.

13. A device as set forth in claim 3 in which said blade is a chisel type blade and an anvil surface is formed on one of said cam member and said stationary member and said chisel type blade and said anvil surface cooperate to form said cutting means for cutting said filament.

14. A device as set forth in claim 13 in which said filament is the string of a guitar.

15. A device as set forth in claim 14 wherein said chisel type blade is provided integrally on said cam member and said anvil surface is provided on said stationary member.

16. A device as set forth in claim 14 in which said anvil surface is provided on said cam member and said chisle type blade is provided integrally on said stationary member.

17. A device as set forth in claim 3 in which a guard member is defined on said stationary member and said guard member is arranged to be adjacent and essentialy parallel to a handle of said cam member when said cam member is in a "clamped" position.

18. A device as set forth in claim 4 in which one of said first and said second clamping surfaces is a frustrum shaped clamping surface and one of said first and said second clamping surfaces is a funnel shaped clamping surface.

19. A device as set forth in claim 16 wherein said filament is the string of a guitar.

20. A device as set forth in claim 16 wherein said first clamping surface is a frustum shaped clamping surface and said second clamping surface is a funnel shaped clamping surface.

21. A device as set forth in claim 10 wherein a plurality of said cam members is employed and said cam members have handles of inequal length.

22. A device for securing a filament to a support member comprising:

a first member rigidly fixed relative to said support member so as to be immobile relative thereto, a second member movably attached to one of said support member and said first member and actuable to move, relative thereto, by means of an actuator connected to said second member, for immobily securing a segment of said filament to said support member against tension in said filament from a given direction relative to said second member;

cutting means comprising a blade formed on one of said first and second members for cutting said filament upon movement of said second member toward a filament securing position.

23. A device as set forth in claim 22 wherein said second member cannot be moved relative to said support member by tension in said filament.

24. A rotary tuner for a musical instrument, comprising:

an actuator;

a rotatable member actuable to rotate via said actuator;

a sleeve fixedly mounted relative to a support member on which said tuner is disposed so as to surround a portion of said rotatable member;

a blade defined on one of said rotatable member and said sleeve for severing a section of a filament disposed on said rotatable member.

25. A rotary tuner as set forth in claim 24 wherein said rotatable member is a string barrel comprising a hole for receiving said string, said hole being disposed at a diagonal angle relative to the rotating axis of said tuner barrel.

26. A rotary tuner as set forth in claim 24 wherein a first blade is defined on a portion of said rotatable member and a second blade is defined on said sleeve and said first and second blades cooperate to define a shearing means.

* * * * *